US009934737B2

(12) United States Patent
Jung et al.

(10) Patent No.: US 9,934,737 B2
(45) Date of Patent: Apr. 3, 2018

(54) DISPLAY APPARATUS AND METHOD OF DRIVING THE DISPLAY APPARATUS

(71) Applicant: SAMSUNG DISPLAY CO., LTD., Yongin, Gyeonggi-do (KR)

(72) Inventors: Kyung-Suk Jung, Cheonan-si (KR); Sung-Ryul Kim, Asan-si (KR); Woo-Sung Sohn, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 16 days.

(21) Appl. No.: 14/677,225

(22) Filed: Apr. 2, 2015

(65) Prior Publication Data

US 2016/0133212 A1 May 12, 2016

(30) Foreign Application Priority Data

Nov. 7, 2014 (KR) ..... 10-2014-0154723

(51) Int. Cl.
*G09G 5/10* (2006.01)
*G09G 3/36* (2006.01)

(52) U.S. Cl.
CPC ..... *G09G 3/3648* (2013.01); *G09G 3/3611* (2013.01); *G09G 3/3688* (2013.01); *G09G 3/3696* (2013.01); *G09G 2300/0876* (2013.01); *G09G 2310/0275* (2013.01); *G09G 2310/0281* (2013.01); *G09G 2310/08* (2013.01); *G09G 2320/0209* (2013.01);
(Continued)

(58) Field of Classification Search
CPC .. G09G 3/3648; G09G 3/3611; G09G 3/3696; G09G 3/3688; G09G 2330/028; G09G 2310/0275; G09G 2310/0281; G09G 2310/08; G09G 2310/0242; G09G 2300/0876; G09G 2320/0209; G09G 2320/041; G09G 2320/0242
See application file for complete search history.

(56) References Cited

U.S. PATENT DOCUMENTS

| | | | |
|---|---|---|---|
| 6,914,586 | B2 | 7/2005 | Burkhardt |
| 6,981,234 | B2 | 12/2005 | Wang et al. |
| 7,027,550 | B2 | 4/2006 | Lin |

(Continued)

FOREIGN PATENT DOCUMENTS

| | | |
|---|---|---|
| EP | 1274068 | 1/2003 |
| EP | 1345197 | 9/2003 |

(Continued)

*Primary Examiner* — Ilana Spar
*Assistant Examiner* — Brent D Castiaux
(74) *Attorney, Agent, or Firm* — F. Chau & Associates, LLC

(57) ABSTRACT

A display apparatus includes a display panel comprising a plurality of pixels, each of the pixels comprising a thin film transistor connected to a gate line and a data line and a display element connected to the thin film transistor, a driving voltage generator configured to generate a gate-on voltage and a plurality of gate-off voltages, a timing controller configured to divide an initial driving period into a plurality of setting periods and output a gate-off voltage corresponding to each of the setting periods, and a gate driver circuit configured to generate a gate signal using the gate-on voltage and the gate-off voltage corresponding to a setting period and output the gate signal to the gate line.

19 Claims, 9 Drawing Sheets

(52) U.S. Cl.
CPC ..... *G09G 2320/0242* (2013.01); *G09G 2320/041* (2013.01); *G09G 2330/028* (2013.01)

(56) References Cited

U.S. PATENT DOCUMENTS

| | | | | |
|---|---|---|---|---|
| 7,136,041 | B2 | 11/2006 | Park | |
| 7,986,290 | B2 | 7/2011 | Yang | |
| 7,992,063 | B2 | 8/2011 | Chang et al. | |
| 8,018,417 | B2 | 9/2011 | Jang et al. | |
| 8,279,617 | B2 | 10/2012 | Choi et al. | |
| 8,314,764 | B2 | 11/2012 | Kim et al. | |
| 8,421,736 | B2 | 4/2013 | Park | |
| 8,537,094 | B2 | 9/2013 | Yang et al. | |
| 8,659,533 | B2 | 2/2014 | Park | |
| 2004/0041778 | A1* | 3/2004 | Hiraki | G09G 3/3688 345/100 |
| 2006/0125758 | A1 | 6/2006 | Yamamura et al. | |
| 2007/0035499 | A1* | 2/2007 | Lee | G09G 3/3655 345/94 |
| 2007/0035501 | A1* | 2/2007 | Moh | G09G 3/3696 345/98 |
| 2007/0085803 | A1* | 4/2007 | Chu | G09G 3/3611 345/98 |
| 2007/0086558 | A1 | 4/2007 | Wei et al. | |
| 2007/0222718 | A1* | 9/2007 | Takahara | G09G 3/2011 345/76 |
| 2008/0079701 | A1* | 4/2008 | Shin | G09G 3/3677 345/204 |
| 2008/0192072 | A1* | 8/2008 | Park | G09G 3/3611 345/690 |
| 2008/0309601 | A1* | 12/2008 | Furukoshi | G09G 3/3648 345/89 |
| 2009/0102773 | A1* | 4/2009 | Um | G02F 1/136213 345/92 |
| 2010/0039364 | A1* | 2/2010 | Lee | G09G 3/3696 345/100 |
| 2010/0097368 | A1* | 4/2010 | Hwang | G09G 3/3677 345/213 |
| 2011/0057959 | A1* | 3/2011 | Park | G09G 3/3648 345/690 |
| 2011/0273416 | A1* | 11/2011 | Bae | G09G 3/3648 345/211 |
| 2014/0078187 | A1 | 3/2014 | Choi | |
| 2014/0139510 | A1* | 5/2014 | Han | G09G 3/3233 345/212 |
| 2014/0313181 | A1* | 10/2014 | Hong | G09G 3/3696 345/212 |
| 2015/0109201 | A1* | 4/2015 | Yamazaki | G06F 3/011 345/156 |

FOREIGN PATENT DOCUMENTS

| | | |
|---|---|---|
| EP | 2369594 | 9/2011 |
| EP | 2542025 | 1/2013 |
| KR | 100188109 | 1/1999 |
| KR | 1020010028629 | 4/2001 |

* cited by examiner

DISPLAY APPARATUS AND METHOD OF DRIVING THE DISPLAY APPARATUS

CROSS-REFERENCE TO RELATED APPLICATIONS

This application claims priority under 35 U.S.C. § 119 to Korean Patent Application No. 10-2014-0154723, filed on Nov. 7, 2014 in the Korean Intellectual Property Office, the disclosure of which is incorporated by reference in its entirety herein.

BACKGROUND

1. Technical Field

Exemplary embodiments of the inventive concept relate to a display apparatus and a method of driving the display apparatus.

2. Discussion of Related Art

Generally, a liquid crystal display (LCD) apparatus has a relatively small thickness, low weight and low power consumption. Thus the LCD apparatus is used in monitors, laptop computers and cellular phones, etc. The LCD apparatus includes an LCD panel displaying images using a selectively changeable light transmittance characteristic of liquid crystals while a backlight assembly disposed under the LCD panel provides light to the LCD panel. A driving circuit drives the LCD panel and thereby causes the selective changes of the light transmittance characteristic of the liquid crystals.

The LCD panel includes an array substrate which has a plurality of gate lines, a plurality of crossing data lines, a plurality of thin film transistors and corresponding pixel electrodes. The LCD also includes an opposing substrate which has a common electrode. An LC layer is interposed between the array substrate and opposing substrate. The driving circuit includes a gate driving part which drives the gate lines of the array substrate and a data driving part which drives the data lines.

However, a vertical crosstalk and a faded color may occur due to an Off voltage level of a gate signal applied to a gate line connected to a gate electrode of the thin film transistor.

BRIEF SUMMARY

At least one exemplary embodiment of the inventive concept provides a display apparatus with improved display quality.

At least one exemplary embodiment of the inventive concept provides a method of driving the display apparatus.

According to an exemplary embodiment of the inventive concept, there is provided a display apparatus. The display apparatus includes a display panel comprising a plurality of pixels, each of the pixels comprising a thin film transistor connected to a gate line and a data line and a display element connected to the thin film transistor, a driving voltage generator configured to generate a gate-on voltage and a plurality of gate-off voltages, a timing controller configured to divide an initial driving period into a plurality of setting periods and output a gate-off voltage having a level corresponding to each of the setting periods, and a gate driver circuit configured to generate a gate signal using the gate-on voltage and the gate-off voltage corresponding to a setting period and output the gate signal to the gate line.

In an exemplary embodiment, the plurality of gate-off voltages may have a plurality of levels which is shifted to a negative direction when driving hours of the thin film transistor increases. In an exemplary embodiment, each gate-off voltage associated with a next setting period is less than the gate-off voltage associated with a previous setting period. In an exemplary embodiment, each gate-off voltage associated with a next setting period is more negative than the gate-off voltage associated with a previous setting period.

In an exemplary embodiment, a first gate-off voltage corresponding to a first setting period of the plurality of setting periods has a negative level adjacent to zero voltage (0V). In an exemplary embodiment, each gate-off voltage has a negative level.

In an exemplary embodiment, the plurality of gate-off voltages have the plurality of levels which is less than a level of a gate-off level at which a faded color occurs due to an Off leakage current of the thin film transistor.

In an exemplary embodiment, each of the pixels further include a storage capacitor connected to the display element, a storage common voltage applied to the storage capacitor may have a level which is changed based on the level of the gate-off voltage in each of the setting periods.

In an exemplary embodiment, the display apparatus further include a temperature sensor configured to sense a temperature in each setting period, a temperature compensator configured to store at least one compensating voltage corresponding to a temperature signal sensed from the temperature sensor, wherein the driving voltage generator is configured to generate a temperature compensated voltage based on the compensating voltage.

In an exemplary embodiment, the temperature compensated voltage has a level which is shifted to a negative direction when the temperature increases. In an exemplary embodiment, each temperature compensated voltage associated with a next higher temperature is less than the temperature compensated voltage associated with a previous lower temperature. In an exemplary embodiment, each temperature compensated voltage associated with a next higher temperature is more negative than the temperature compensated voltage associated with a previous lower temperature.

In an exemplary embodiment, the driving voltage generator is configured to add the temperature compensated voltage to the gate-off voltage to generate a resulting voltage and provide the gate driver circuit with the resulting voltage.

In an exemplary embodiment, the initial driving period is equal to or less than about 100 hours.

In an exemplary embodiment, the gate-off voltage after the initial driving period is maintained at a level of the gate-off voltage corresponding to a last setting period of the initial driving period.

According to an exemplary embodiment of the inventive concept, there is provided a method of driving a display apparatus. The method includes generating a plurality of gate-off voltages different from each other during a plurality of setting periods, where each gate-off voltage corresponds to one of a plurality of setting periods of an initial driving period, and for each setting period, generating a gate signal using a gate-on voltage and the gate-off voltage having a level corresponding to the setting period, and providing a thin film transistor in a pixel of a display panel of the display apparatus with the gate signal.

In an exemplary embodiment, the plurality of gate-off voltages has a plurality of levels which is shifted to a negative direction when a driving hours of the thin film transistor increases. In an exemplary embodiment, each gate-off voltage associated with a later setting period is less than the gate-off voltage associated with an earlier setting period. In an exemplary embodiment, each gate-off voltage associated with a later setting period is more negative than the gate-off voltage associated with an earlier setting period.

In an exemplary embodiment, a first gate-off voltage corresponding to a first setting period of the plurality of setting periods has a negative level adjacent to zero voltage (0V). In an exemplary embodiment, each gate-off voltage has a negative level.

In an exemplary embodiment, the plurality of gate-off voltages has the plurality of levels which is less than a level of the gate-off level at which a faded color occurs due to an Off leakage current of the thin film transistor.

In an exemplary embodiment, the method further includes generating a storage common voltage having a level which is changed based on the level of the gate-off voltage in each of the setting periods, wherein each of the pixels further include a storage capacitor connected to the display element, the storage common voltage applied to the storage capacitor.

In an exemplary embodiment, the method further includes, for each setting period, sensing a temperature and generating a temperature compensated voltage based on a compensating voltage corresponding to the sensed temperature.

In an exemplary embodiment, the temperature compensated voltage has a level which is shifted to a negative direction when the temperature increases. In an exemplary embodiment, each temperature compensated voltage associated with a next higher temperature is less than the temperature compensated voltage associated with a previous lower temperature. In an exemplary embodiment, each temperature compensated voltage associated with a next higher temperature is more negative than the temperature compensated voltage associated with a previous lower temperature.

In an exemplary embodiment, the temperature compensated voltage is added to the gate-off voltage to generate a resulting voltage and the gate signal is generated using the resulting voltage.

In an exemplary embodiment, the initial driving period is equal to or less than about 100 hours.

According to an exemplary embodiment of the inventive concept, a driver for a display apparatus is provided. The driver includes a gate driver and a timing controller. The timing controller is configured to control the gate driver to generate a gate signal with a gate-on voltage and a gate-off voltage of a first level during a first period for application to a gate line, set the gate-off voltage to a second level during a second period, and maintain a level of the gate-off voltage during all periods after the second period, where the second level is more negative than the first level. In an exemplary embodiment, the driver further includes a temperature sensor configured to sense a temperature during the first and second periods and a temperature compensator configured to add a compensation voltage to each gate-off voltage according to the sensed temperatures. In an exemplary embodiment, each compensation voltage associated with a next higher sensed temperature is more negative than the compensated voltage associated with a previous lower sensed temperature.

According to at least one embodiment of the inventive concept, during initial driving hours of the thin film transistor, the gate-off voltage is set to a negative level which is adjacent to about 0V and thus, vertical crosstalk may be reduced or removed. When the driving hours of the thin film transistor increase, the gate-off voltage is set to a negative level further shifted to a negative direction and thus, the faded color margin increases.

BRIEF DESCRIPTION OF THE DRAWINGS

The inventive concept will become more apparent by describing exemplary embodiments thereof in detail with reference to the accompanying drawings, in which.

DETAILED DESCRIPTION

Hereinafter, the inventive concept will be explained in detail with reference to the accompanying drawings. As will be appreciated by one skilled in the art, aspects of the present disclosure may be embodied as a system, a method, or a computer program product. Accordingly, aspects of the present disclosure may take the form of an entirely hardware embodiment, an entirely software embodiment (including firmware, resistant software, micro-code, etc.), or an embodiment combining software and hardware aspects that may all generally be referred to herein as a "circuit", "module", or "system". Furthermore, aspects of the present disclosure may take the form of a computer program product embodied in one or more computer readable medium(s) having computer readable program code embodied thereon. Please note that when driving hours is used herein, it may correspond to a driving period of various durations in various units such as seconds, minutes, hours, etc., and fractions of those units.

Figure 1:
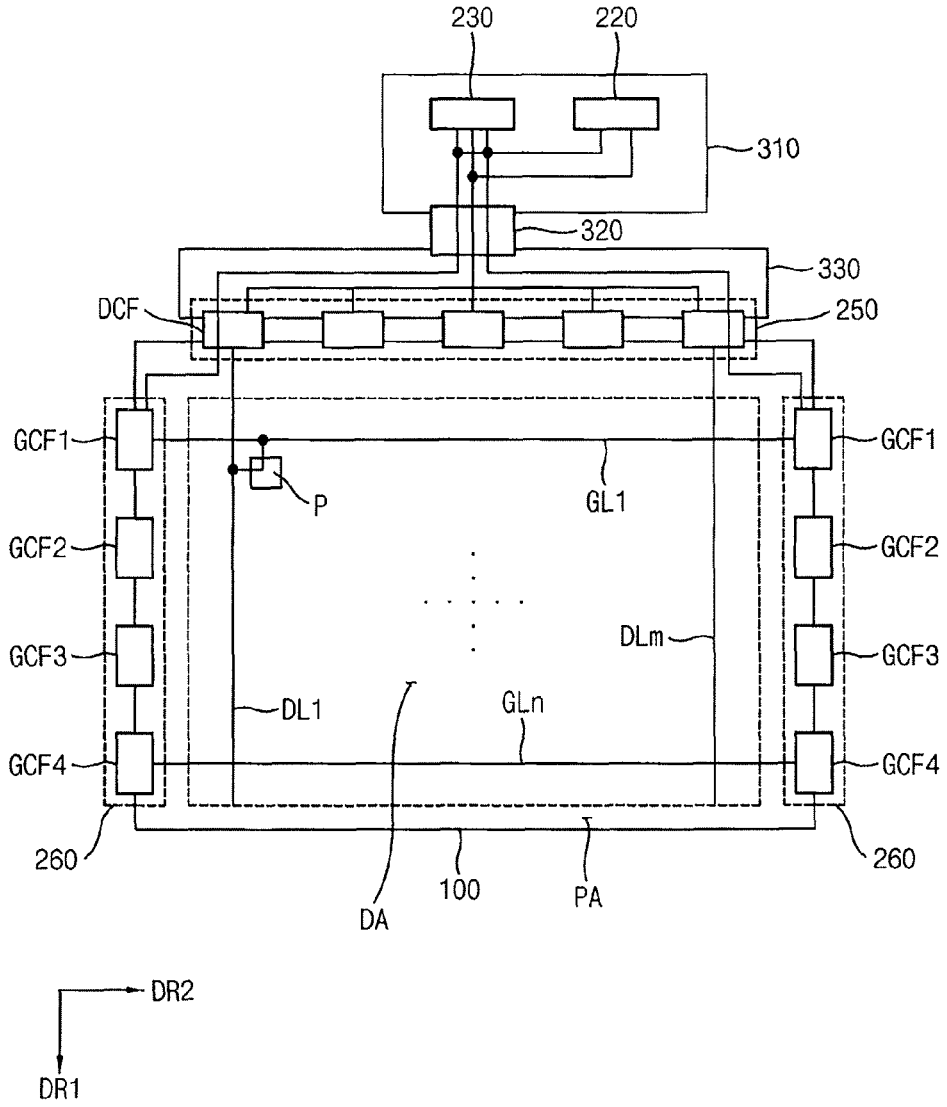
FIG. 1 is a plan view illustrating a display apparatus according to an exemplary embodiment of the inventive concept.
Figure 2:
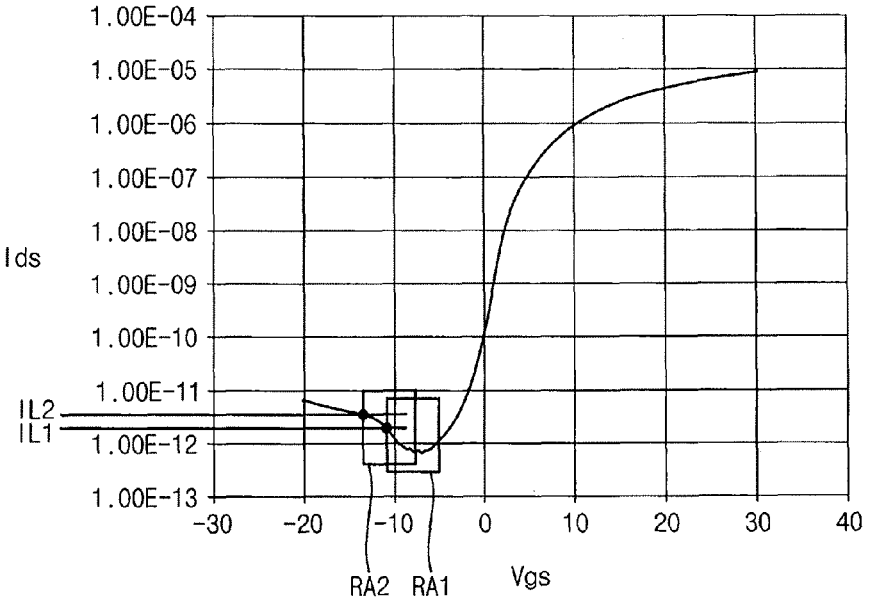
FIG. 2 is a curve illustrating a characteristic of a thin film transistor.
Figure 3:
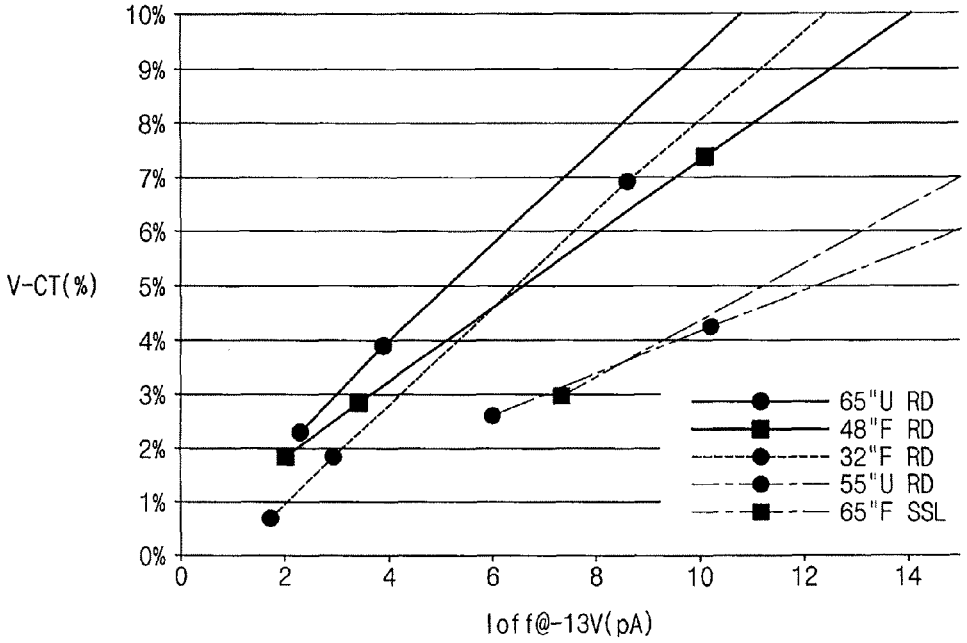
FIG. 3 is a graph diagram illustrating a vertical crosstalk due to an Off leakage current of the thin film transistor of FIG. 1.
Figure 4:
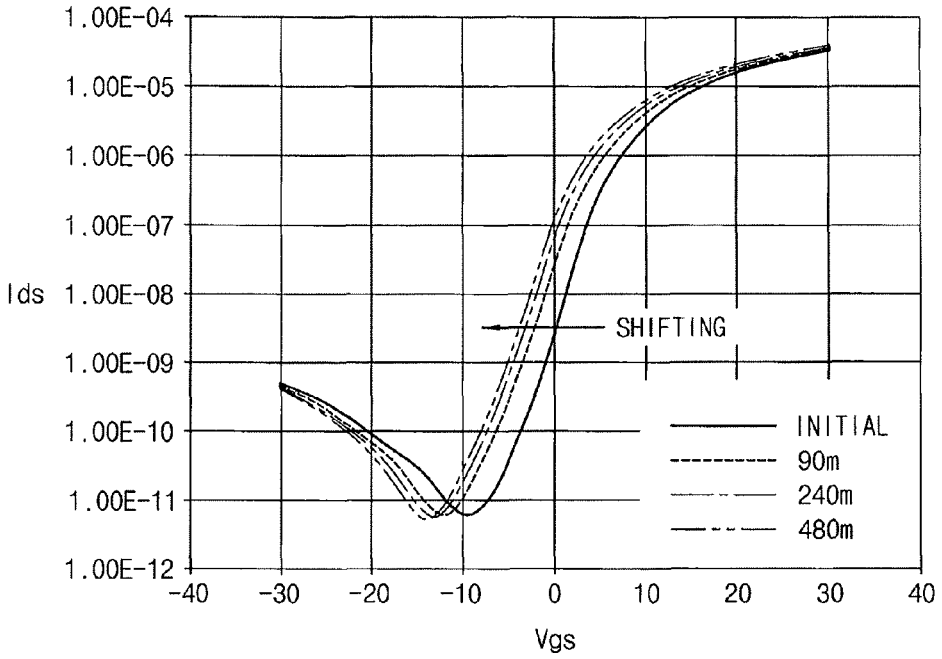
FIG. 4 is a curve illustrating a characteristic change of the thin film transistor according to driving hours.

FIG. 1 is a plan view illustrating a display apparatus according to an exemplary embodiment of the inventive concept. FIG. 2 is a curve illustrating a characteristic of a thin film transistor. FIG. 3 is a graph diagram illustrating a vertical crosstalk due to an Off-leakage current of the thin film transistor of FIG. 1. FIG. 4 is a curve illustrating a characteristic change of the thin film transistor according to driving hours.

Referring to FIG. 1, the display apparatus includes a display panel 100, a driving voltage generator 220, a timing controller 230, a data driver circuit 250, and at least one gate driver circuit 260.

The display apparatus includes a control circuit board 310, at least one circuit film 320 and at least one source circuit board 330. The timing controller 230 is disposed on the control circuit board 310. A first end portion of the circuit film 320 is connected to the control circuit board 310 and a second end portion of the circuit film 320 is connected to the source circuit board or disposed on the source circuit board 330. An end portion of the data driver circuit 250 is connected to the source circuit board 330.

The display panel 100 includes a display area DA and a peripheral area PA surrounding the display area DA. A plurality of pixels P, a plurality of data lines DL and a plurality of gate lines GL are disposed in the display area DA. The data driver circuit 250 and at least one gate driver circuit 260 are disposed in the peripheral area PA.

The pixels P may be arranged as a matrix type which includes pixel columns arranged in a first direction DR1 and a pixel rows arranged in a second direction DR2 crossing the first direction DR1.

The data lines DL1, . . . , DLm extend in the first direction DR1 and are arranged in the second direction DR2. Each of the data lines DL1, . . . , DLm is electrically connected to pixels P in a same pixel column and is configured to transfer a data signal.

The gate lines GL1, . . . , GLn extend in the second direction DR2 and are arranged in the first direction DR1. Each of the gate lines GL1, . . . , GLn is electrically connected to pixels P in a same pixel row and is configured to transfer a gate signal.

Each of the pixels P includes a thin film transistor which is connected to a gate line (e.g., GL1) and a data line (e.g., DL1), a display element which is connected to the thin film transistor, and a storage capacitor which is connected to the display element. The display element may include a liquid crystal (LC) capacitor, an organic light-emitting diode (OLED) and so on.

Referring to FIG. 2, a characteristic curve illustrates a source-drain current according to a gate-source voltage of the thin film transistor. According to the characteristic curve of the thin film transistor, an Off leakage current level IL2 in a second voltage range RA2 which is non-adjacent to 0V is more than an Off leakage current level IL1 in a first voltage range RA1 which is adjacent to 0V.

Referring to a vertical crosstalk V-CT according to the Off leakage current Ioff as shown in FIG. 3, when the Off leakage current Ioff increases, the vertical crosstalk V-CT increases. In addition, when a size of the display panel increases, an increase range of the vertical crosstalk V-CT according to an increase of the Off leakage current Ioff increases.

Thus, when a gate-off voltage is set to a negative voltage adjacent to 0V based on the first voltage range RA1 of the gate-source voltage Vgs, a level of the Off leakage current is low and thus, the vertical crosstalk may be removed or reduced. However, a faded color may occur.

The faded color is a defect which may occur when a characteristic curve of the thin film transistor is shifted to a positive level. The faded color is a state in which a black grayscale is changed to a white grayscale when a gate-off voltage is adjacent to 0V. A faded color margin is a voltage at which the faded color is observed and which is subtracted from the gate-off voltage. Thus, when the gate-off voltage is not adjacent to 0V, the faded color margin may increase.

Therefore, when the gate-off voltage is set to the second voltage range RA2 being non-adjacent to 0V, the faded color margin may increase. As described above, the vertical crosstalk conflicts with the faded color.

However, as shown in FIG. 4, when driving hours of the thin film transistor increase, the characteristic curve of the thin film transistor is shifted to the negative direction.

According to an exemplary embodiment of the inventive concept, during an initial driving period of the thin film transistor, the gate-off voltage is set to a negative voltage which is adjacent to about 0V and thus, the vertical crosstalk may be reduced or removed. When the driving hours increase, the gate-off voltage is set to a negative voltage which is adjacent to about −20V to shift the characteristic curve to a negative direction and thus, the faded color margin increases.

According to the exemplary embodiment of the inventive concept, an initial driving period of the display panel is divided into a plurality of setting periods. A plurality of gate-off voltages respectively corresponding to characteristic curves which are gradually shifted to the negative direction, is generated and respectively correspond to the plurality of setting periods. The display panel 100 is driven using the plurality of gate-off voltages during the initial driving period.

The driving voltage generator 220 is configured to generate a driving voltage for the display apparatus. The driving voltage includes a data driving voltage for driving the data driver circuit 250, a gate driving voltage for driving the gate driver circuit 260 and a panel driving voltage for driving the display panel 100.

According to an exemplary embodiment of the inventive concept, the gate driving voltage includes a least one gate-on voltage and a plurality of gate-off voltages respectively corresponding to a plurality of setting periods. The plurality of gate-off voltages has a plurality of levels which is determined based on the characteristic curve of thin film transistor shifted to a negative direction when the driving hours increase. Thus, the vertical crosstalk and faded color may be reduced or removed. For example, the later the setting period, the more negative the gate-off voltage associated with the setting period becomes. For example, the gate-off voltage of a setting period later in time is negative and less than the negative gate-off voltage of a setting period earlier in time.

The timing controller 230 is configured to control the driving voltage generator 220, the data driver circuit 250 and the first and second gate driver circuits 260.

The timing controller 230 is configured to control the driving voltage generator 220. The timing controller 230 is configured to control the driving voltage generator 220 to provide the gate driver circuit 260 with the plurality gate-off voltages respectively corresponding to the plurality of setting periods of the initial driving period.

The timing controller 230 is configured to correct a data signal using various compensation algorithms and to provide the data driver circuit 250 with the corrected data signal. The timing controller 230 is configured to control an operation of the data driver circuit 250 and the gate driver circuit 260.

The data driver circuit 250 includes a plurality of data circuit films DCF, and each of the data circuit films DCF includes a data driver chip configured to drive a data line. The data circuit film DCF is electrically configured to the source circuit board 330 and the display panel 100. The data circuit films adjacent to the gate driver circuit 260 are configured to transfer the gate control signal received from the control circuit board 310 to the gate driver circuits 260. The data driver circuit 250 is configured to drive the data lines DL1, . . . , DLm based on the data signal.

The gate driver circuit 260 includes a plurality of gate circuit films GCF1, . . . , GCF4. Each of the gate circuit films GCF1, . . . , GCF4 includes a gate driver chip configured to drive a gate line. The gate driver circuit 260 is disposed in the peripheral area PA adjacent to an end portion of the gate line. The gate driver circuit 260 is configured to drive the gate lines GL1, . . . , GLn.

Figure 5:
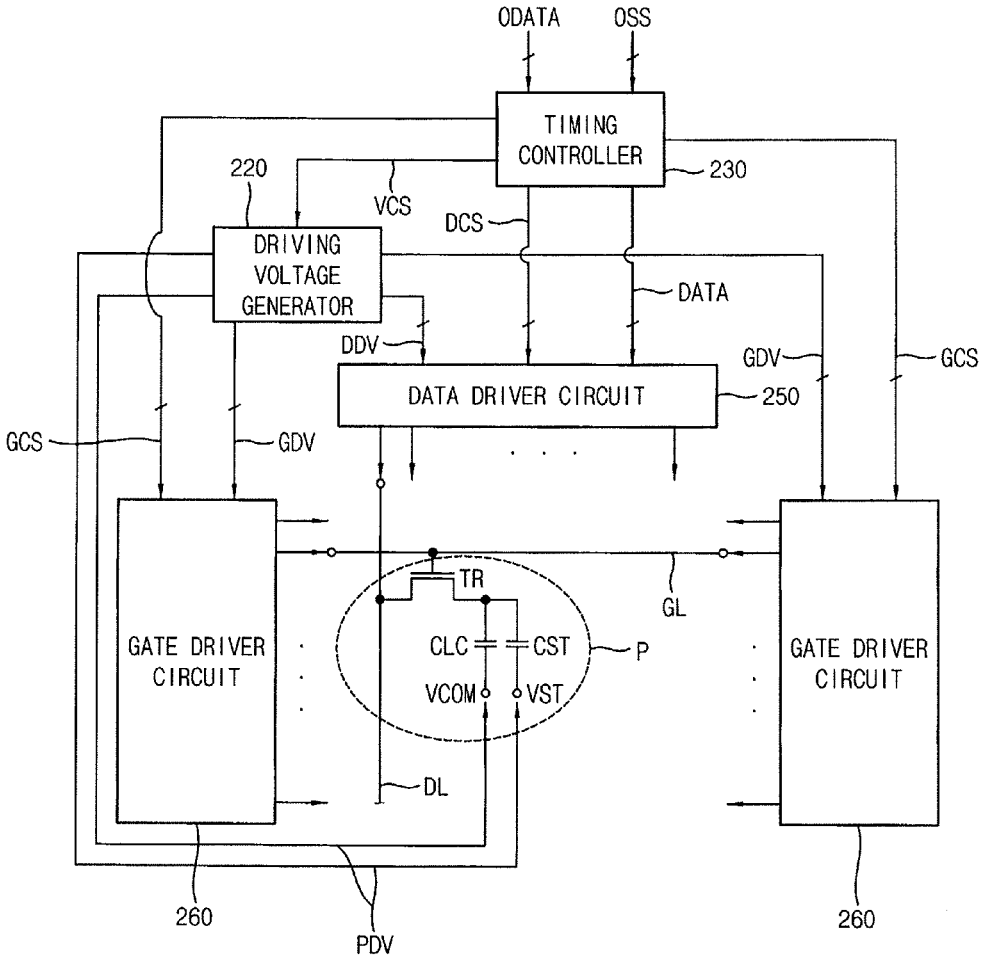
FIG. 5 is a block diagram illustrating the display apparatus of FIG. 1.

FIG. 5 is a block diagram illustrating the display apparatus of FIG. 1.

Referring to FIGS. 1 and 5, the display apparatus includes a pixel P, a driving voltage generator 220, a timing controller 230, a data driver circuit 250, and at least one gate driver circuit 260.

The pixel P includes a thin film transistor TR connected to a gate line GL and a data line DL, an LC capacitor CLC connected to the thin film transistor TR and a storage capacitor CST connected to the LC capacitor CLC.

The driving voltage generator 220 is configured to generate a data driving voltage DDV, a gate driving voltage GDV and a panel driving voltage PDV.

The data driving voltage DDV may include an analog source voltage AVDD and a digital source voltage DVDD and the gate driving voltage GDV may include a gate-on voltage VON and a gate-off voltage VSS. The panel driving voltage PDV may include a common voltage VCOM applied to the LC capacitor CLC and a storage common voltage VST applied to the storage capacitor CST. The common voltage VCOM and the storage common voltage VST may be equal to each other.

According to an exemplary embodiment of the inventive concept, the gate driving voltage includes a least one gate-on voltage and a plurality of gate-off voltages respectively corresponding to a plurality of setting periods. The plurality of gate-off voltages has a plurality of levels which is determined based on the characteristic curve of thin film transistor shifted to a negative direction when the driving hours increase. For example, a first gate-off voltage corresponding to a first setting period has a first level and a second gate-off voltage corresponding to a second setting period delayed from first setting period has a second level based on the characteristic curve which is further shifted to the negative direction in comparison with the characteristic curve corresponding to the first level of the first gate-off voltage. For example, the second level is less than the first level and both levels are less than 0V.

The timing controller 230 is configured to receive an original synch signal (OSS) and an original data signal ODATA. The timing controller 230 is configured to correct the original data signal ODATA using various compensation algorithms and to provide the data driver circuit 250 with the corrected data signal DATA.

The timing controller 230 is configured to generate a voltage control signal VCS, a data control signal DCS and a gate control signal GCS based on the original synch signal (OSS).

The voltage control signal VCS controls the driving voltage generator 220 to output a gate-off voltage corresponding to the setting period during a setting period of the initial driving period.

The data control signal DCS may include a data synch signal which includes a horizontal synch signal, a vertical synch signal and a load signal which controls an output timing of the data signal.

The gate control signal GCS may include a vertical start signal which controls a start of the gate driver circuit 260, a gate clock signal which controls a rising timing of a gate signal and a gate enable signal which controls a falling timing of the gate signal.

The data driver circuit 250 is configured to convert the data signal DATA into a data voltage using the analog source voltage AVDD and output the data voltage to the data line DL based on the data control signal DCS.

The gate driver circuit 260 is configured to generate the gate signal having the gate-on voltage and the gate-off voltage based on the gate clock signal and output the gate signal to the gate line GL.

The gate driver circuit 260 is configured to generate a plurality of gate signals based on the gate-on voltage and the gate-off voltage received from the driving voltage generator 220 and the gate control signal GCS received from the timing controller 230. According to an exemplary embodiment of the inventive concept, the gate signals respectively corresponding to the setting periods have a plurality of low levels.

According to an exemplary embodiment of the inventive concept, during the first setting period, a gate signal which has a high level of the gate-on voltage and a low level of a first gate-off voltage is applied to the thin film transistor TR of the pixel P. Then, during the second setting period, a gate signal which has a high level of the gate-on voltage and a low level of a second gate-off voltage is applied to the thin film transistor TR of the pixel P.

According to an exemplary embodiment of the inventive concept, during initial driving hours of the thin film transistor, the gate-off voltage is set to a negative level which is adjacent to about 0V and thus, the vertical crosstalk may be reduced or removed. When the driving hours of the thin film transistor increase, the gate-off voltage is set to a negative level further shifted to a negative direction and thus, the faded color margin increases. For example, as the driving hours increase, the gate-off voltage becomes more and more negative in stages until it is finally maintained at a constant level.

Figure 6:
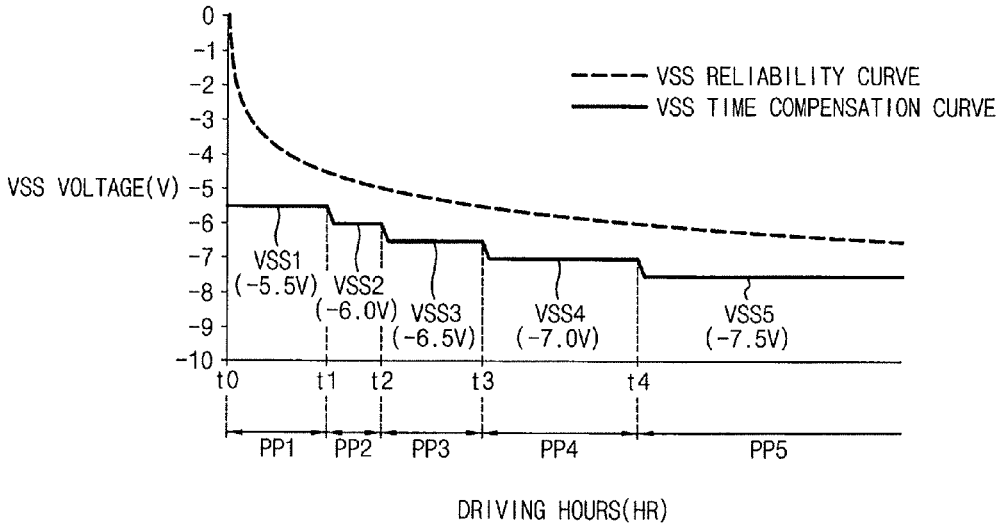
FIG. 6 is a graph diagram illustrating a method of driving a display apparatus according to an exemplary embodiment of the inventive concept.
Figure 7:
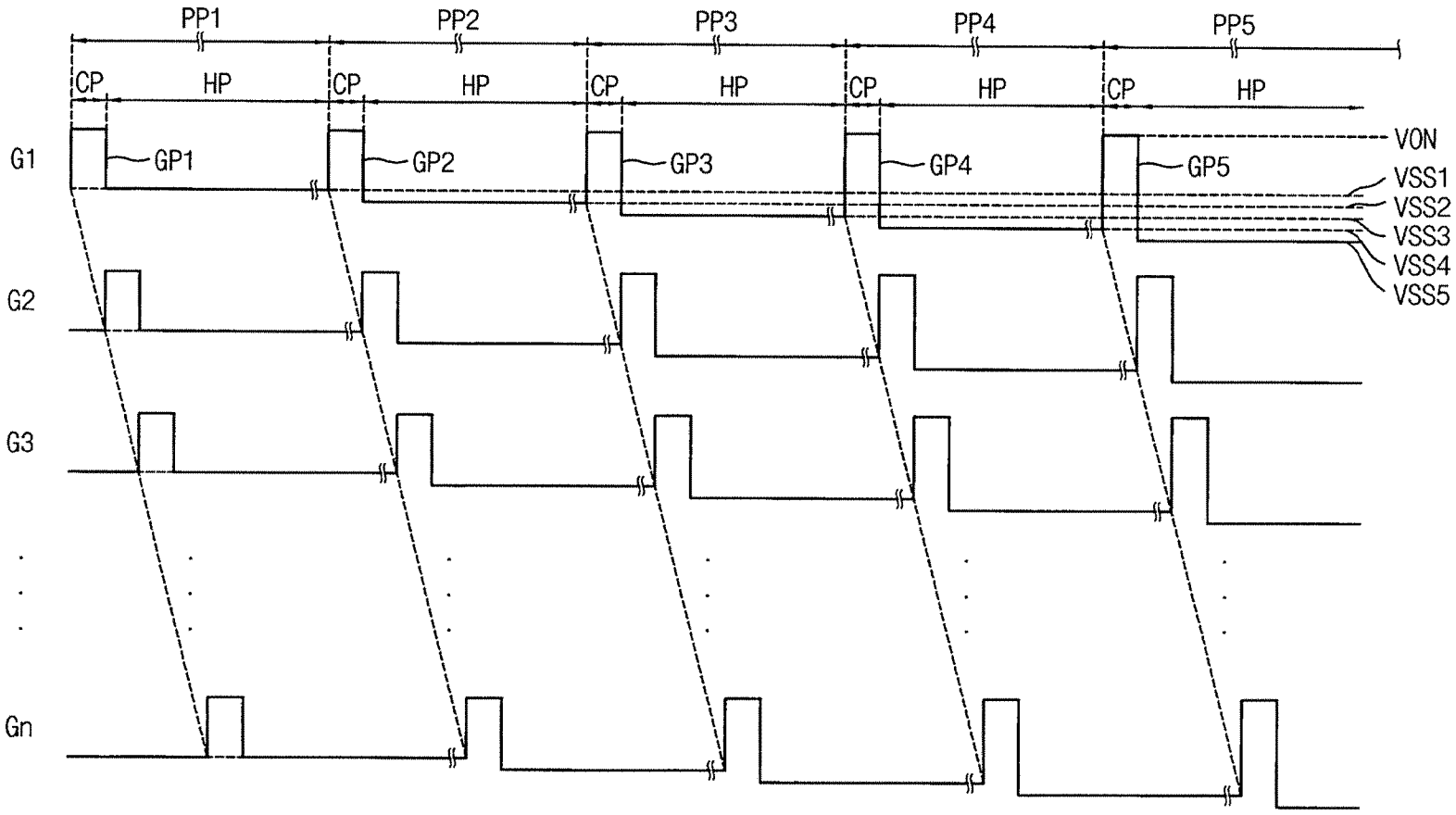
FIG. 7 is a waveform diagram illustrating a driving signal according to the method of FIG. 6.

FIG. 6 is a graph diagram illustrating a method of driving a display apparatus according to an exemplary embodiment of the inventive concept. FIG. 7 is a waveform diagram illustrating a driving signal according to the method of FIG. 6.

Referring to FIG. 6, a VSS reliability curve is levels of the gate-off voltages at which the faded color occurs according to driving hours. A VSS time compensation curve is levels of the gate-off voltages having a faded color margin corresponding to the driving hours according to an exemplary embodiment of the inventive concept.

Referring to the VSS reliability curve, during the initial driving period (t0 to t4), when the driving hours increase, the level of the gate-off voltage at which the faded color occurs is shifted to a negative direction. And then, the level of the gate-off voltage is maintained at a constant level from a certain hour, for example, a fourth time t4. For example, the level of the gate-off voltage is maintained at the constant level after time t4. Thus, referring to the VSS time compensation curve according to an exemplary embodiment of the inventive concept, a level of the gate-off voltage may have a margin of about −1V in comparison with the VSS reliability curve.

Hereinafter, a method of driving the display apparatus according to an exemplary embodiment of the inventive concept is explained.

Referring to FIGS. 6 and 7, an initial driving period (t0 to t4) of the display apparatus is divided into a plurality of setting periods PP1, PP2, PP3, PP4 and PP5. The initial driving period may be equal to or less than about 100 hours.

The driving voltage generator 220 is configured to provide the gate driver circuit 260 with a gate-on voltage VON and a first gate-off voltage VSS1 during a first setting period PP1 which ranges from a Power-ON time t0 to a first time t1, based on a control of the timing controller 230.

The first gate-off voltage VSS1 is set to be adjacent to a positive level, for example, about 0V, such that a vertical crosstalk may be reduced or removed. For example, the first gate-off voltage VSS1 may be set to a normal gate-off voltage, for example, about −5.5V.

During the first setting period PP1, the gate driver circuit 260 is configured to generate a first gate signal GP1 using the gate-on voltage VON and the first gate-off voltage VSS1. The first gate signal GP1 has a high level during a data charging period CP of a frame period during which a data voltage is charged in the LC capacitor, and has a first low level corresponding to the first gate-off voltage VSS1 during a data holding period HP of the frame period during which the data voltage charged in the LC capacitor is maintained. During the first setting period PP1, the display panel is driven by the first gate signal GP1 having the gate-on voltage VON and the first gate-off voltage VSS1.

Then, the driving voltage generator 220 is configured to provide the gate driver circuit 260 with a gate-on voltage VON and a second gate-off voltage VSS2 during a second setting period PP2 which ranges from the first time t1 to a second time t2, based on a control of the timing controller 230.

The second gate-off voltage VSS2 is set to a negative level which is shifted to the negative direction with respect to the first gate-off voltage VSS1 based on the characteristic curve of the thin film transistor shifting to the negative direction when the driving hours increase. For example, the second gate-off voltage VSS2 may be set to about −6.0V.

During the second setting period PP2, the gate driver circuit 260 is configured to generate a second gate signal GP2 using the gate-on voltage VON and the second gate-off voltage VSS2. The second gate signal GP2 has a high level during the data charging period CP of the frame period during which a data voltage is charged in the LC capacitor, and has a second low level corresponding to the second gate-off voltage VSS2 during the data holding period HP of the frame period during which the data voltage charged in the LC capacitor is maintained. During the second setting period PP2, the display panel is driven by the second gate signal GP2 having the gate-on voltage VON and the second gate-off voltage VSS2.

Then, the driving voltage generator 220 is configured to provide the gate driver circuit 260 with a gate-on voltage VON and a third gate-off voltage VSS3 during a third setting period PP3 which ranges from the second time t2 to a third time t3, based on a control of the timing controller 230.

The third gate-off voltage VSS3 is set to a negative level which is shifted to the negative direction with respect to the second gate-off voltage VSS2 based on the characteristic curve of the thin film transistor shifting to the that negative direction when the driving hours increase. For example, the third gate-off voltage VSS3 may be set to about −6.5V.

During the third setting period PP3, the gate driver circuit 260 is configured to generate a third gate signal GP3 using the gate-on voltage VON and the third gate-off voltage VSS3. The third gate signal GP3 has a high level during the data charging period CP of the frame period during which a data voltage is charged in the LC capacitor, and has a third low level corresponding to the third gate-off voltage VSS3 during the data holding period HP of the frame period during which the data voltage charged in the LC capacitor is maintained. During the third setting period PP3, the display panel is driven by the third gate signal GP3 having the gate-on voltage VON and the third gate-off voltage VSS3.

Then, the driving voltage generator 220 is configured to provide the gate driver circuit 260 with a gate-on voltage VON and a fourth gate-off voltage VSS4 during a fourth setting period PP4 which ranges from the third time t3 to a fourth time t4, based on a control of the timing controller 230.

The fourth gate-off voltage VSS4 is set to a negative level which is shifted to the negative direction with respect to the third gate-off voltage VSS3 based on the characteristic curve of the thin film transistor shifting to the that negative direction when the driving hours increase. For example, the fourth gate-off voltage VSS4 may be set to about −7.0V.

During the fourth setting period PP4, the gate driver circuit 260 is configured to generate a fourth gate signal GP4 using the gate-on voltage VON and the fourth gate-off voltage VSS4. The fourth gate signal GP4 has a high level during the data charging period CP of the frame period during which a data voltage is charged in the LC capacitor, and has a fourth low level corresponding to the fourth gate-off voltage VSS4 during the data holding period HP of the frame period during which the data voltage charged in the LC capacitor is maintained. During the fourth setting period PP4, the display panel is driven by the fourth gate signal GP4 having the gate-on voltage VON and the fourth gate-off voltage VSS4.

Then, the driving voltage generator 220 is configured to provide the gate driver circuit 260 with a gate-on voltage VON and a fifth gate-off voltage VSS5 during a fifth setting period PP5 which ranges from the fourth time t4 for a fifth setting period PP5, based on a control of the timing controller 230.

The fifth gate-off voltage VSS5 is set to a negative level which is shifted to the negative direction with respect to the fourth gate-off voltage VSS4 based on the characteristic curve of the thin film transistor shifting to the negative direction when the driving hours increase. For example, the fifth gate-off voltage VSS5 may be set to about −7.5V.

During the fifth setting period PP5, the gate driver circuit 260 is configured to generate a fifth gate signal GP5 using the gate-on voltage VON and the fifth gate-off voltage VSS5. The fifth gate signal GP5 has a high level during the data charging period CP of the frame period during which a data voltage is charged in the LC capacitor, and has a fifth low level corresponding to the fifth gate-off voltage VSS5 during the data holding period HP of the frame period during which the data voltage charged in the LC capacitor is maintained. During the fifth setting period PP5, the display panel is driven by the fifth gate signal GP5 having the gate-on voltage VON and the fifth gate-off voltage VSS5.

As shown in FIG. 7, based on the VSS reliability curve of FIG. 6, the display panel is driven by the fifth gate signal GP5 having the gate-on voltage VON and the fifth gate-off voltage VSS5 from the fourth time T4 and thereafter.

While the above discusses use of five setting periods and levels, the inventive concept is limited any particular number of setting periods and levels. For example, in alternate embodiments, more than five setting periods and levels are used or less than five setting periods and levels are used. Further, while the above discusses each next setting level being 0.5V less than the prior setting level, the inventive concept is not limited thereto. For example, in alternate embodiments, the difference between setting levels may be less than 0.5V or more than 0.5 V.

Although not shown in figures, in order to compensate for a kickback voltage, a common voltage VCOM of the LC capacitor CLC and a storage common voltage VCT of a storage capacitor CST may be adjusted based on the level of the gate-off voltage during every setting period.

According to an exemplary embodiment of the inventive concept, during an initial driving period of the thin film transistor, the gate-off voltage is set to a negative voltage which is adjacent to about 0V and thus, the vertical crosstalk may be reduced or removed. When the driving hours increase, the gate-off voltage is set to a negative voltage further shifted to a negative direction and thus, the faded color margin increases. For example, the gate-off voltage is initially set to a first negative voltage, and then after the display has been driven using this gate-off voltage for a period (e.g., a certain number of seconds, minutes, hours, etc.), the gate-off voltage is set to a second negative voltage that is more negative than (e.g., less than) the first negative voltage, and then display is then driven with the new gate-off voltage for an additional period. This process may continue until the gate-off voltage reaches a predetermined level, which is then maintained thereafter.

Figure 8:
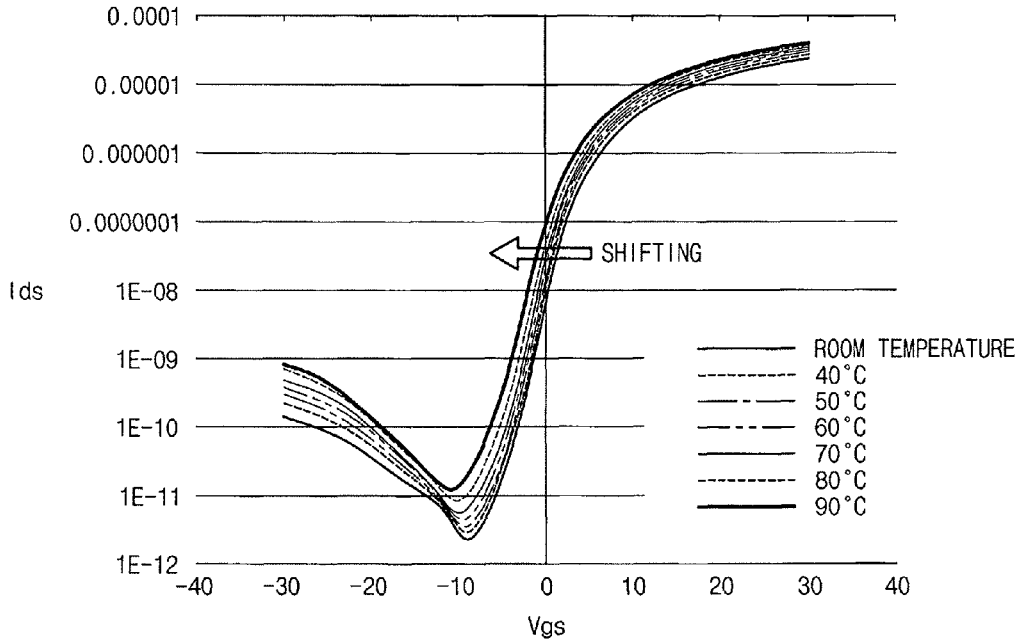
FIG. 8 is a curve illustrating a characteristic change of the thin film transistor according to a temperature change.
Figure 9:
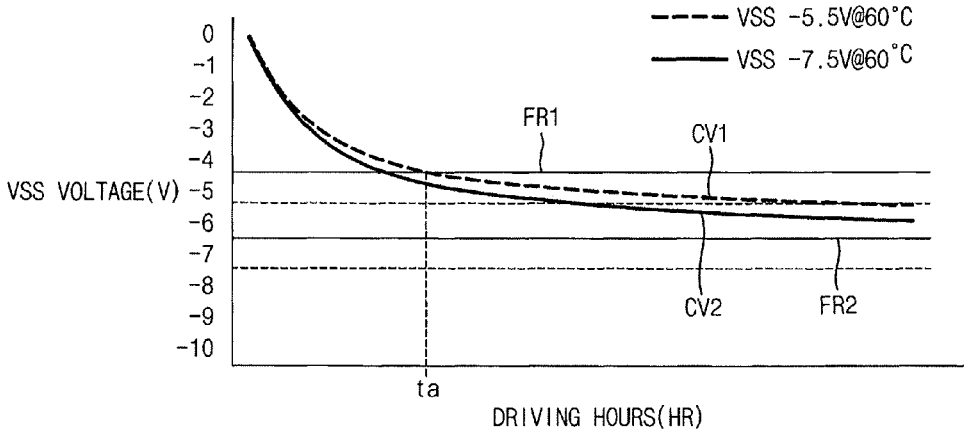
FIG. 9 is a curve illustrating a faded color according to a temperature and a gate-off voltage.

FIG. 8 is a curve illustrating a characteristic change of the thin film transistor according to a temperature change. FIG. 9 is a curve illustrating a faded color according to a temperature and a gate-off voltage.

Referring to a characteristic curve of thin film transistor according to a peripheral temperature change as shown in FIG. 8, when the peripheral temperature increases, a characteristic curve of a thin film transistor may be shifted to a negative direction. Thus, the gate-off voltage is shifted to a negative direction according to a temperature increase such that a faded color margin may increase.

Referring to FIG. 9, a first VSS curve CV1 is levels of gate-off voltages at which a faded color occurs according to driving hours when the display panel is driven based on the peripheral temperature of about 60° C. and a gate-off voltage of about −5.5V according to a first comparative exemplary embodiment. Referring to the first VSS curve CV1, when the driving hours increase, a level of the gate-off voltage VSS is shifted to a negative direction and then is maintained at a constant level at a level of about −6.5V.

According to the first comparative exemplary embodiment, a first fail reference voltage FR1 for a reliability evaluation of the faded color is set to about −4.5V having a margin of 1V, and thus when the gate-off voltage VSS is dropped below the first fail reference voltage FR1, this case results in a faded color defect. Referring to the first VSS curve CV1, the gate-off voltage VSS is dropped below the first fail reference voltage FR1 after a period 'ta' of an initial driving period. Thus, a display apparatus according to the first comparative exemplary embodiment has the faded color defect after the period 'ta' of the initial driving period.

However, a second VSS curve CV2 is levels of gate-off voltages at which a faded color occurs according to driving hours when the display panel is driven based on the peripheral temperature of about 60° C. and a gate-off voltage of about −7.5V according to a second comparative exemplary embodiment. Referring to the second VSS curve CV2, when the driving hours increase, a level of the gate-off voltage VSS is shifted to a negative direction and then is maintained at a constant level at a level of about −6.0V.

According the second comparative exemplary embodiment, a second fail reference voltage FR2 for a reliability evaluation of the faded color is set to about −6.5V having a margin of 1V, and thus when the gate-off voltage VSS is dropped below the second fail reference voltage FR2, this case results in a faded color defect. Referring to the second VSS curve CV2, the gate-off voltage VSS is not dropped below the second fail reference voltage FR2. Thus, a display apparatus according to the second comparative exemplary embodiment does not have the faded color defect during the initial driving period.

According to an exemplary embodiment, when the peripheral temperature is higher than a room temperature or a threshold temperature, a level of the gate-off voltage is shifted to a negative direction. Thus, the faded color margin may increase.

Figure 10:
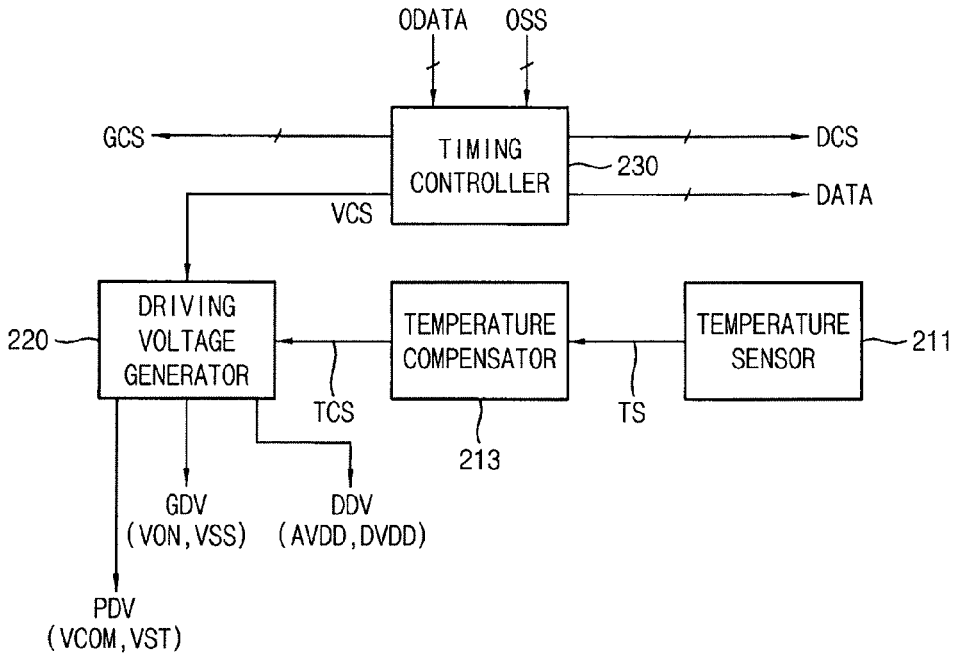
FIG. 10 is a graph diagram illustrating a method of driving a display apparatus according to an exemplary embodiment of the inventive concept.
Figure 11:
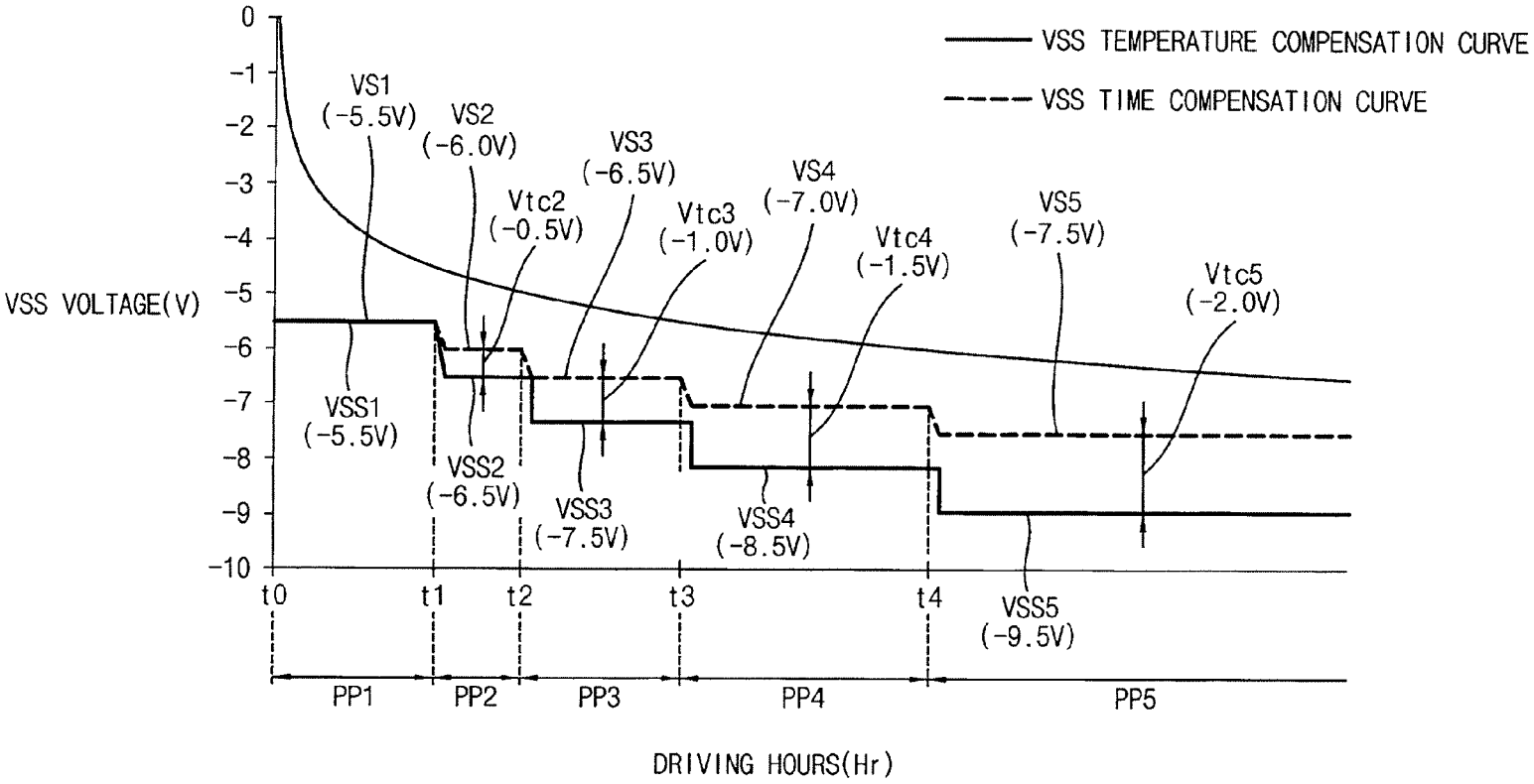
FIG. 11 is a waveform diagram illustrating a driving signal according to the method of FIG. 10.

FIG. 10 is a graph diagram illustrating a method of driving a display apparatus according to an exemplary embodiment of the inventive concept. FIG. 11 is a waveform diagram illustrating a driving signal according to the method of FIG. 10.

Hereinafter, the same reference numerals are used to refer to the same or like parts as those described in the previous exemplary embodiments, and the same detailed explanations are not repeated unless necessary.

In a display apparatus according to an exemplary embodiment of the inventive concept, a level of a gate-off voltage is adjusted according to driving hours and a peripheral temperature such that a vertical crosstalk and a faded color may be reduced or removed.

For example, referring to FIG. 10, the display apparatus includes a temperature sensor 211, a temperature compensator 213, a driving voltage generator 220 and a timing controller 230.

The temperature sensor 211 is configured to sense a temperature and a peripheral temperature of the display apparatus and provide the temperature compensator 213 with a temperature signal TS. The temperature signal TS may indicate an amount of the sensed temperature. Examples of the temperature sensor 211 include a thermistor, a thermocouple, a resistance thermometer, and a silicon bandgap temperature sensor.

The temperature compensator 213 is configured to store at least one compensating voltage corresponding to the temperature signal TS. The temperature compensator 213 is configured to provide the driving voltage generator 220 with the compensating voltage TCS corresponding to the temperature signal TS.

For example, the temperature compensator 213 may include a look-up table which stores at least one compensating voltage TCS respectively corresponding to a plurality of temperature signals. At least one first compensating voltage corresponding to a first temperature signal and at least one second compensating voltage corresponding to a second temperature signal, may be stored in the look-up table. Thus, when the temperature compensator 213 receives the first temperature signal from the temperature sensor 211, the temperature compensator 213 is configured to provide the driving voltage generator 220 with the at least one compensating voltage corresponding to the first temperature signal.

The driving voltage generator 220 is configured to further generate a temperature compensated voltage for compensating a temperature in comparison with a previous exemplary embodiment. The temperature compensated voltage is generated based on the compensating voltage. The temperature compensated voltage is added to the gate-off voltage controlled based on driving hours as described in the previous exemplary embodiment and the added gate-off voltage is applied to the gate driver circuit 260. Thus, the gate driver circuit 260 may be provided with the gate-off voltage compensated based on the driving hours and the temperature.

The timing controller 230 is driven with a same method as those described in the previous exemplary embodiment, and the same detailed explanations are not repeated unless necessary.

Referring to FIG. 11, a VSS reliability curve is levels of the gate-off voltages at which the faded color occurs according to driving hours. A VSS time compensation curve is levels of the gate-off voltages having a faded color margin corresponding to the driving hours. A VSS temperature compensation curve is levels of the gate-off voltages having a faded color margin corresponding to the temperature.

According to an exemplary embodiment of the inventive concept, a temperature compensated voltage according to the temperature is added to a level of the gate-off voltage based on the VSS time compensation curve and thus, the gate-off voltage VSS of the VSS temperature compensation curve is generated.

When the display apparatus is powered-on, the temperature sensor 211 is configured to sense a first temperature of the display apparatus during a preset sensing period. For example, the preset sensing period may occur on or before time t0. The temperature sensor 211 is configured to provide the temperature compensator 213 with a first temperature signal corresponding to the first temperature. The temperature compensator 213 is configured to provide the driving voltage generator 220 with a first compensating voltage corresponding to the first temperature signal. The driving voltage generator 220 is configured to generate a first temperature compensated voltage Vtc1 based on the first compensating voltage.

During a first setting period PP1, the driving voltage generator 220 is configured to output a gate-on voltage VON and a first gate-off voltage VSS1. The first temperature compensated voltage Vtc1 is added to a first Off voltage VS1 corresponding to the VSS time compensation curve and thus, the first gate-off voltage VSS1 is generated.

The first Off voltage VS1 is set to a level adjacent to about 0V for removing the vertical crosstalk. For example, the first Off voltage VS1 may be set to a normal gate-off level such as about −5.5V. When the first temperature corresponds to a room temperature, the first temperature compensated voltage Vtc1 may be about 0.0V. Thus, the first gate-off voltage VSS1 may be set to about −5.5V.

As shown in FIG. 7, during the first setting period PP1, the gate driver circuit 260 is configured to generate a first gate signal GP1 using the gate-on voltage VON and the first gate-off voltage VSS1. The first gate signal GP1 has a high level during a data charging period CP of a frame period during which a data voltage is charged in the LC capacitor, and has a first low level corresponding to the first gate-off voltage VSS1 during a data holding period HP of the frame period during which the data voltage charged in the LC capacitor is maintained. During the first setting period PP1, the display panel is driven by the first gate signal GP1 having the gate-on voltage VON and the first gate-off voltage VSS1.

Then, when the driving hours has reached a first time t1 that is a start of a second setting period PP2 which ranges from the first time t1 to a second time t2, the temperature sensor 211 is configured to sense a second temperature of the display apparatus and provide the temperature compensator 213 with a second temperature signal corresponding to the second temperature. The temperature compensator 213 is configured to provide the driving voltage generator 220 with a second compensating voltage corresponding to the second temperature signal and the driving voltage generator 220 is configured to generate a second temperature compensated voltage Vtc2 based on the second compensating voltage.

During the second setting period PP2, the driving voltage generator 220 is configured to output the gate-on voltage VON and a second gate-off voltage VSS2. The second temperature compensated voltage Vtc2 is added to a second Off voltage VS2 of the VSS time compensation curve and thus, the second gate-off voltage VSS2 is generated.

The second Off voltage VS2 is set to a negative level which is shifted to the negative direction with respect to the first Off voltage VS1 based on the characteristic curve of the thin film transistor shifting to the negative direction when the driving hours increase. For example, the second Off voltage VS2 may be set to about −6.0V. The second temperature is higher than the first temperature. The second temperature compensated voltage Vtc2 is set to a negative level which is shifted to the negative direction with respect to the first temperature compensated voltage Vtc1 based on the characteristic curve of the thin film transistor. For example, the second temperature compensated voltage Vtc2 may be about −0.5V. Thus, the second gate-off voltage VSS2 may be set to about −6.5V.

As shown in FIG. 7, during the second setting period PP2, the gate driver circuit 260 is configured to generate a second gate signal GP2 using the gate-on voltage VON and the second gate-off voltage VSS2. The second gate signal GP2 has a high level during the data charging period CP of the frame period during which a data voltage is charged in the LC capacitor, and has a second low level corresponding to the second gate-off voltage VSS2 during the data holding period HP of the frame period during which the data voltage charged in the LC capacitor is maintained.

Then, when the driving hours has reached a second time t2 that is a start of the third setting period PP3 which ranges from the second time t2 to a third time t3, the temperature sensor 211 is configured to sense a third temperature of the display apparatus and provide the temperature compensator 213 with a third temperature signal corresponding to the third temperature. The temperature compensator 213 is configured to provide the driving voltage generator 220 with a third compensating voltage corresponding to the third temperature signal and the driving voltage generator 220 is configured to generate a third temperature compensated voltage Vtc3 based on the third compensating voltage.

During the third setting period PP3, the driving voltage generator 220 is configured to output the gate-on voltage VON and a third gate-off voltage VSS3. The third temperature compensated voltage Vtc3 is added to a third Off voltage VS3 of the VSS time compensation curve and thus, the third gate-off voltage VSS3 is generated.

The third Off voltage VS3 is set to a negative level which is shifted to the negative direction with respect to the second Off voltage VS2 based on the characteristic curve of the thin film transistor shifting to the negative direction when the driving hours increase. For example, the third Off voltage VS3 may be set to about −6.5V. The third temperature is higher than the second temperature. The third temperature compensated voltage Vtc3 is set to a negative level which is shifted to the negative direction with respect to the second temperature compensated voltage Vtc2 based on the characteristic curve of the thin film transistor. For example, the third temperature compensated voltage Vtc3 may be about −1.0V. Thus, the third gate-off voltage VSS3 may be set to about −7.5V.

As shown in FIG. 7, during the third setting period PP3, the gate driver circuit 260 is configured to generate a third gate signal GP3 using the gate-on voltage VON and the third gate-off voltage VSS3. The third gate signal GP3 has a high level during the data charging period CP of the frame period during which a data voltage is charged in the LC capacitor, and has a third low level corresponding to the third gate-off voltage VSS3 during the data holding period HP of the frame period during which the data voltage charged in the LC capacitor is maintained.

Then, when the driving hours has reached a third time t3 that is a start of a fourth setting period PP4 which is ranges from the third time t3 to a fourth time t4, the temperature sensor 211 is configured to sense a fourth temperature of the display apparatus and provide the temperature compensator 213 with a fourth temperature signal corresponding to the fourth temperature. The temperature compensator 213 is configured to provide the driving voltage generator 220 with a fourth compensating voltage corresponding to the fourth temperature signal and the driving voltage generator 220 is configured to generate a fourth temperature compensated voltage Vtc4 based on the fourth compensating voltage.

During the fourth setting period PP4, the driving voltage generator 220 is configured to output the gate-on voltage VON and a fourth gate-off voltage VSS4. The fourth temperature compensated voltage Vtc4 is added to a fourth Off voltage VS4 of the VSS time compensation curve and thus, the fourth gate-off voltage VSS4 is generated.

The fourth Off voltage VS4 is set to a negative level which is shifted to the negative direction with respect to the third Off voltage VS3 based on the characteristic curve of the thin film transistor shifting to the negative direction when the driving hours increase. For example, the fourth Off voltage VS4 may be set to about −7.0V. The fourth temperature is higher than the third temperature. The fourth temperature compensated voltage Vtc4 is set to a negative level which is shifted to the negative direction with respect to the third temperature compensated voltage Vtc3 based on the characteristic curve of the thin film transistor. For example, the fourth temperature compensated voltage Vtc4 may be about −1.5V. Thus, the fourth gate-off voltage VSS4 may be set to about −8.5V As shown in FIG. 7, during the fourth setting period PP4, the gate driver circuit 260 is configured to generate a second gate signal GP2 using the gate-on voltage VON and the fourth gate-off voltage VSS4. The fourth gate signal GP4 has a high level during the data charging period CP of the frame period during which a data voltage is charged in the LC capacitor, and has a fourth low level corresponding to the fourth gate-off voltage VSS4 during the data holding period HP of the frame period during which the data voltage charged in the LC capacitor is maintained.

Then, when the driving hours has reached a fourth time t4 that is a start of a fifth setting period PP5 which begins after the fourth time t4, the temperature sensor 211 is configured to sense a fifth temperature of the display apparatus and provide the temperature compensator 213 with a fifth temperature signal corresponding to the fifth temperature. The temperature compensator 213 is configured to provide the driving voltage generator 220 with a fifth compensating voltage corresponding to the fifth temperature signal and the driving voltage generator 220 is configured to generate a fifth temperature compensated voltage Vtc5 based on the fifth compensating voltage.

During the fifth setting period PP5, the driving voltage generator 220 is configured to output the gate-on voltage VON and a fifth gate-off voltage VSS5. The fifth temperature compensated voltage Vtc5 is added to a fifth Off voltage VS52 of the VSS time compensation curve and thus, the fifth gate-off voltage VSS5 is generated.

The fifth Off voltage VS5 is set to a negative level which is shifted to the negative direction with respect to the fourth Off voltage VS4 based on the characteristic curve of the thin film transistor shifting to the negative direction when the driving hours increase. For example, the fifth Off voltage VS5 may be set to about −7.5V. The fifth temperature is higher than the fourth temperature. The fifth temperature compensated voltage Vtc5 is set to a negative level which is shifted to the negative direction with respect to the fourth temperature compensated voltage Vtc4 based on the characteristic curve of the thin film transistor. For example, the fifth temperature compensated voltage Vtc5 may be about −2.0V. Thus, the fifth gate-off voltage VSS5 may be set to about −9.5V.

As shown in FIG. 7, during the fifth setting period PP5, the gate driver circuit 260 is configured to generate a fifth gate signal GP5 using the gate-on voltage VON and the fifth gate-off voltage VSS5. The fifth gate signal GP5 has a high level during the data charging period CP of the frame period during which a data voltage is charged in the LC capacitor, and has a fifth low level corresponding to the fifth gate-off voltage VSS5 during the data holding period HP of the frame period during which the data voltage charged in the LC capacitor is maintained.

As described above, according to at least one exemplary embodiment of the inventive concept, during initial driving hours of the thin film transistor, the gate-off voltage is set to a negative level which is adjacent to about 0V and thus, the vertical crosstalk may be reduced or removed. When the driving hours of the thin film transistor increase, the gate-off voltage is set to a negative level further shifted to a negative direction and thus, the faded color margin increases.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the inventive concept. Accordingly, all such modifications are intended to be included within the scope of the inventive concept.

What is claimed is:

1. A display apparatus comprising:

a display panel comprising a plurality of pixels, each of the pixels comprising a thin film transistor connected to a gate line and a data line and a display element connected to the thin film transistor;

a driving voltage generator configured to generate a gate-on voltage and a plurality of gate-off voltages having voltage levels different from each other;

a timing controller configured to divide an initial driving period into a plurality of distinct setting periods comprising at least a first setting period, a second setting period, and a third setting period, and during each setting period to output one of the gate-off voltages having a level corresponding to the setting period; and a gate driver circuit configured to generate a gate signal using the generated gate-on voltage and the one output gate-off voltage and output the gate signal to the gate line, wherein the gate-off voltage associated with the second setting period is less than the gate-off voltage associated with the first setting period and greater than the gate-off voltage associated with the third setting period, wherein the second setting period occurs after the first setting period and before the third setting period, wherein the gate-off voltage is shifted in a negative direction and then maintained at a constant level during each of the setting periods following the first setting period.

2. The display apparatus of claim 1, wherein each gate-off voltage has a negative level.

3. The display apparatus of claim 1, wherein the levels of the gate-off voltages are less than a level of a gate-off level at which a faded color occurs due to an Off leakage current of the thin film transistor.

4. The display apparatus of claim 1, wherein each of the pixels further comprise a storage capacitor connected to the display element, a storage common voltage applied to the storage capacitor has a level which is changed based on the level of the gate-off voltage in each of the setting periods.

5. The display apparatus of claim 1, further comprising:

a temperature sensor configured to sense a temperature in each setting period; and a temperature compensator configured to store at least one compensating voltage corresponding to a temperature signal sensed from the temperature sensor, wherein the driving voltage generator is configured to generate a temperature compensated voltage based on the compensating voltage.

6. The display apparatus of claim 5, wherein each temperature compensated voltage associated with a next higher temperature is less than the temperature compensated voltage associated with a previous lower temperature.

7. The display apparatus of claim 6, wherein the driving voltage generator is configured to add the temperature compensated voltage to the gate-off voltage to generate a resulting voltage and provide the gate driver circuit with the resulting voltage.

8. The display apparatus of claim 1, wherein the initial driving period is equal to or less than about 100 hours.

9. The display apparatus of claim 1, wherein the gate-off voltage after the initial driving period has elapsed is maintained at a level of the gate-off voltage corresponding to a last setting period of the initial driving period.

10. A method of driving a display apparatus, the method comprising:

generating a plurality of gate-off voltages having voltage levels different from each other, wherein each gate-off voltage corresponds to one of a plurality of distinct setting periods of an initial driving period of the display apparatus, the setting periods generated by dividing the initial driving period into at least a first setting period, a second setting period, and a third setting period;

during each setting period, generating a gate signal using a gate-on voltage and one of the gate-off voltages having a level corresponding to the setting period; and providing a thin film transistor in a pixel of a display panel of the display apparatus with the gate signal, wherein the gate-off voltage associated with the second setting period is less than the gate-off voltage associated with the first setting period and greater than the gate-off voltage associated with the third setting period, wherein the second setting period occurs after the first setting period and before the third setting period, wherein the gate-off voltage is shifted in a negative direction and then maintained at a constant level during each of the setting periods following the first setting period.

11. The method of claim 10, wherein each gate-off voltage has a negative level.

12. The method of claim 10, wherein the levels of the gate-off voltages are less than a level of a gate-off level at which a faded color occurs due to an Off leakage current of the thin film transistor.

13. The method of claim 10, further comprising:

generating a storage common voltage having a level which is changed based on the level of the gate-off voltage in each of the setting periods, wherein each of the pixels further comprises a storage capacitor connected to the display element, the storage common voltage applied to the storage capacitor.

14. The method of claim 10, further comprising:

for each setting period, sensing a temperature; and generating a temperature compensated voltage based on a compensating voltage corresponding to the sensed temperature.

15. The method of claim 14, wherein each temperature compensated voltage associated with a next higher temperature is less than the temperature compensated voltage associated with a previous lower temperature.

16. The method of claim 15, wherein the temperature compensated voltage is added to the one gate-off voltage to generate a resulting voltage and the gate signal is generated using the resulting voltage.

17. The method of claim 10, wherein the initial driving period is equal to or less than about 100 hours.

18. A driver for a display apparatus, the driver comprising:

a gate driver;

a timing controller configured to control the gate driver to generate a gate signal with a gate-on voltage and a gate-off voltage of a first negative voltage level during a first period for application to a gate line, set the gate-off voltage to a second negative voltage level during a second period that occurs after the first period, and maintain a level of the gate-off voltage during all periods after the second period, wherein the second negative voltage level is less than the first negative voltage level;

a temperature sensor configured to sense a temperature during the first and second periods; and a temperature compensator configured to add a compensation voltage to each gate-off voltage according to the sensed temperatures, wherein the gate-off voltage is shifted in a negative direction and then maintained at a constant level during each of the periods following the first period.

19. The driver of claim 18, wherein each compensated voltage associated with a next higher temperature is less than the compensated voltage associated with a previous lower temperature.

* * * * *